United States Patent [19]

Doherty et al.

[11] Patent Number: 4,840,765

[45] Date of Patent: Jun. 20, 1989

[54] PRECIPITATE HYDROLYSIS PROCESS FOR THE REMOVAL OF ORGANIC COMPOUNDS FROM NUCLEAR WASTE SLURRIES

[75] Inventors: Joseph P. Doherty, Elkton, Md.; James C. Marek, Augusta, Ga.

[73] Assignee: The United States of America as represented by the United States Department of Energy, Washington, D.C.

[21] Appl. No.: 18,389

[22] Filed: Feb. 25, 1987

[51] Int. Cl.[4] ..... G21F 9/14

[52] U.S. Cl. ..... 376/310; 376/313; 252/631; 252/632; 210/682; 423/12

[58] Field of Search ..... 376/310, 313; 252/631, 252/632, 626; 110/237; 210/682; 423/2, 12

[56] References Cited

U.S. PATENT DOCUMENTS 4,432,893 2/1984 Lee ..... 252/631

4,686,068 8/1987 Saida ..... 252/632

OTHER PUBLICATIONS

Dowerty et al., DPST-84-98, Revision 2, Jul. 1985, E. I. Du Pont de Nemours & Co., Aiken S.C.

Doherty, Joseph P. et al.; Defense Waste Processing Facility Precipitate Hydrolysis Process DP-MS-8-5-132.

Doherty, Joseph P.; Process Innovations to Minimize Waste Volumes at Savannah River DP-MS-86-26.

Kuivila et al.; 86 J. Of American Chemical Society 2666 (1964).

*Primary Examiner*—Donald P. Walsh

*Attorney, Agent, or Firm*—Allen F. Westerdahl; William R. Moser

[57] ABSTRACT

A process for removing organic compounds from a nuclear waste slurry comprising reacting a mixture of radioactive waste precipitate slurry and an acid in the presence of a catalytically effective amount of a copper (II) catalyst whereby the organic compounds in the precipitate slurry are hydrolyzed to form volatile organic compounds which are separated from the reacting mixture. The resulting waste slurry, containing less than 10 percent of the orginal organic compounds, is subsequently blended with high level radioactive sludge and transferred to a virtrification facility for processing into borosilicate glass for long-term storage.

26 Claims, 2 Drawing Sheets

PRECIPITATE HYDROLYSIS PROCESS FOR THE REMOVAL OF ORGANIC COMPOUNDS FROM NUCLEAR WASTE SLURRIES

BACKGROUND OF THE INVENTION

One of the problems facing the nuclear industry today is that of disposing of the large amounts of radioactive waste generated by nuclear reactors. As an example, the Savannah River Plant operated by the Department of Energy has generated nearly 300,000 cubic meters of high level radioactive waste since the plant startup in the early 1950's. It is estimated that this figure will increase at the rate of up to 15,000 cubic meters of waste per year. Consequently, as the Savannah River Plant is but one of the many nuclear plants operating today, there is tremendous interest in devising methods to deal with and reduce these huge quantities of radioactive materials by safe and efficient means.

The radioactivity of the soluble waste materials is due primarily to three radionuclides: cesium-137; strontium-90; and plutonium. Of these three substances, cesium-137 accounts, by itself, for more than 99 percent of the radioactivity of the soluble waste materials. Thus, it is especially desirable to be able to concentrate the cesium-137 in order to decrease the total amount of material which it contaminates.

A process has been developed to separate the above three radionuclides from waste solution. This process, described in Lee et al., U.S. Pat. No. 4,432,893, comprises adding sodium tetraphenylborate (NaTPB) and sodium titanate ($NaTi_2O_5H$) to a waste solution, whereby cesium-137 is precipitated out as insoluble CsTPB, and strontium-90 and plutonium are absorbed onto the $NaTi_2O_5H$ by means of an ion exchange process to form their respective titanates which are likewise insoluble. After filtration, the remaining aqueous solution has been decontaminated by a factor of 104 for cesium-137, up to 200 for strontium-90, and up to 500 for plutonium. Following filtration, the concentrated, radioactive solids are combined with a sludge fraction of the waste and are then vitrified into borosilicate glass, which in turn is placed in suitable containers for long-term storage.

In the vitrification process, which occurs in a glass melter operated at about 1100° C., cations are reduced to oxides which are incorporated into the glass matrix. Most of the anions and all of the hydrocarbons are oxidized and removed through the off-gas system. For each mole of $C_6H_5$-oxidized, approximately 7.5 moles of oxygen are required and 9 moles of gas are generated. Removal of the organic compounds prior to the vitrification step would decrease both the amount of oxygen required and the volume of gas generated. This, in turn, would decrease the size and complexity of the off-gas system. It is, therefore, highly desirable to develop a means by which the amount of organic compounds in the concentrated radioactive wastes can be decreased in order to facilitate operation of the glass melter.

It has been found that hydrolysis of the organic compounds in acidic solutions results in evolution of organic vapors which are relatively free from radioactivity. In particular, solutions of formic acid (HC00H) were found effective as they provided the necessary acidity without contributing any undesirable anions into an already complex mixture. However, there are several drawbacks to existing hydrolysis processes.

Among the most serious of the drawbacks is foaming within the hydrolysis reactor caused by the concentrated tetraphenylborate precipitate slurry trapping evolved gases. Heating the precipitate slurry during the hydrolysis reaction causes gases to be evolved from solution and these gases are trapped in the precipitate slurry to form a stable foam. The extent of this problem is apparent from the fact that at a suitable reaction temperature, the resulting foam layer more than doubles the apparent volume of the solution. The foaming problem is magnified by the fact that trace contaminants within the precipitate slurry react in the acidic reaction solution to produce other gases, such as nitrogen oxides and carbon dioxide, which add to the foam. To contain this foam, a pressure vessel which is maintained above ambient pressure is needed as a reactor. This vessel is sealed prior to heating and may be reopened only after the hydrolysis reactions have occurred and the foam has been dispersed. For example, an earlier, uncatalyzed, hydrolysis reaction required a pressure vessel with the reaction occurring at a pressure ranging from about 25 to 50 pounds per square inch gauge for a period of about 5 hours. For a number of reasons, including safety considerations, process complexity, and limitations on service pressure, it was desirable to avoid the requirement of elevated pressure for the reaction to proceed efficiently.

In addition, and just as importantly, earlier hydrolysis reactions achieve no better than about 75 percent removal of the organic compounds. Thus, the considerations of safety, complexity, and efficiency were motivating factors to develop a hydrolysis process that would overcome the limitations and deficiencies of earlier processes.

SUMMARY OF THE INVENTION

It is, therefore, an object of the present invention to provide a process by which the amount of organic compounds in concentrated radioactive wastes is decreased in order to facilitate downstream processing of the nuclear waste material.

It is another object of the present invention to remove as much of the aromatic organic compounds in the radioactive waste as possible in order to optimize a downstream vitrification process.

It is still another object of the present invention to decrease the level of radioactivity in the organic compounds to permit the safe incineration of the organic materials.

It is still another object of the present invention to provide a process to hydrolyze organic compounds in radioactive waste without requiring elevated pressure or pressurized reactor vessels.

More narrowly, the object of the present invention is to remove at least 90 percent of the aromatic organic compounds from concentrated radioactive waste to facilitate subsequent vitrification of the waste, and to decontaminate the organic compounds to a level of below about 1000 disintegrations per minute per milliliter (d/min./ml.) in order to permit safe incineration of the organic compounds.

The present invention achieves these desired goals by providing a process with improved efficiency and safety, and decreased complexity. Basically, it has been found that catalytically effective amounts of copper (II) cations catalyze the hydrolysis reaction to a degree sufficient to make operation of the process efficient. In particular, copper (II) sulfate and copper (II) formate have been found to make the hydrolysis reaction proceed at lower temperatures, at ambient pressure, and with improved yields of evolved organic compounds (greater than 90 percent).

An aspect of the present invention is accomplished by providing a process for removing organic compounds from a radioactive waste precipitate slurry, comprising hydrolyzing the slurry with an acid in the presence of a catalytically effective amount of copper (II) cations and separating the resulting hydrolyzed organic compounds.

Another aspect of the invention is accomplished by providing a process for removing organic compounds from a radioactive waste precipitate slurry, comprising the steps of:

(a) contacting the precipitate slurry with an acid in the presence of a catalytically effective amount of copper (II) cations to form an acidified slurry;

(b) heating the acidified slurry to a temperature sufficient to effect hydrolysis of the organic compounds, thereby forming volatile organic compounds; and (c) separating the volatile organic compounds from said acidified slurry.

DETAILED DESCRIPTION OF THE PREFERRED EMBODIMENTS

The invention comprises a hydrolysis process for removing organic compounds from radioactive waste slurry wherein the hydrolysis reaction is catalyzed by a catalytically effective amount of copper (II) cations. In a preferred embodiment a batch process is used, but it is to be understood that it is within the scope of the invention to conduct the hydrolysis reaction by other means, including, but not limited to, a continuous process.

Figure 1:
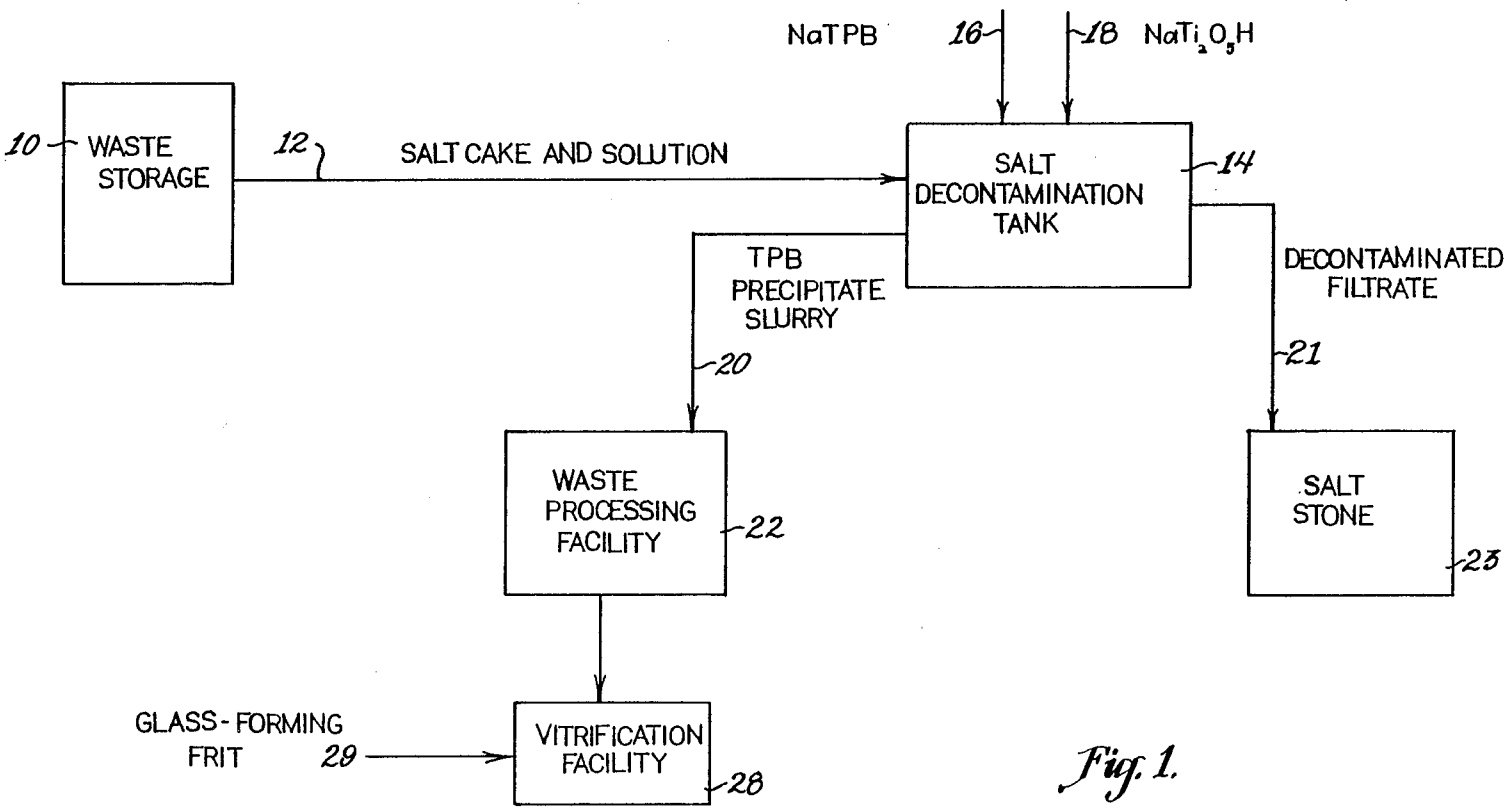
FIG. 1 is a schematic diagram of an overall radioactive waste processing operation.

Typical radioactive waste solutions comprise nitrates, nitrites, aluminates, and hydroxides of sodium with the additional presence of radioactive nuclides including cesium, strontium, and traces of plutonium. FIG. 1 illustrates the overall scheme of waste processing operations. The solution portion of the radioactive waste 12 is transported from waste storage tank 10 into the salt decontamination tank 14 where sodium tetraphenylborate 16 and sodium titanate 18 are added in order to precipitate the radioactive nuclides cesium-137, strontium-90 and plutonium. After filtration, the decontaminated filtrate 21 is processed into salt stone 23. The precipitate slurry 20, containing the insoluble radioactive compounds, is transported into a waste processing facility 22. Following the hydrolysis reaction which removes the organic compounds from the radionuclides, the resulting radioactive inorganic material 26 is transferred to a vitrification facility 28 where the radioactive material is incorporated into borosilicate glass and placed into suitable containers for long-term storage.

Figure 2:
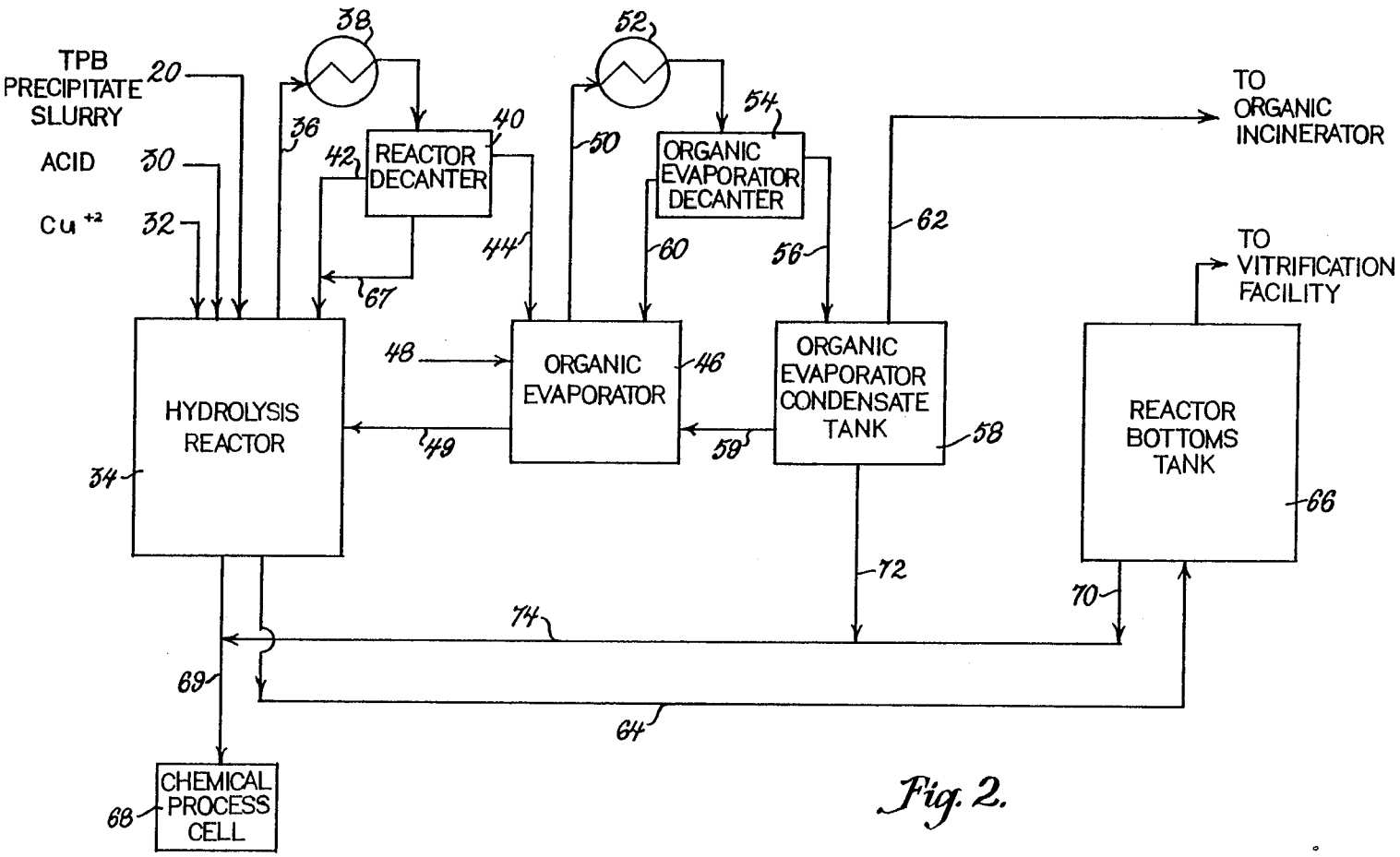
FIG. 2 is a schematic diagram of the precipitate hydrolysis process within the waste processing facility.

FIG. 2 illustrates the precipitate hydrolysis process which occurs within the waste processing facility 22. To the hydrolysis reactor 34 are added an acid 30, preferably formic acid, and the copper (II) catalyst 32 in the form of, preferably, copper (II) sulfate or copper (II) formate. The mixture of solutions in the hydrolysis reactor is then heated to a temperature of about 70 to 100° C., and preferably about 90° C. Concentrated radioactive tetraphenylborate precipitate slurry 20 from salt decontamination tank 14 is then fed into the hydrolysis reactor 34 at a controlled rate over a period of at least one-half hour. As the precipitate slurry enters the hot solution, it is diluted and begins to undergo hydrolysis. Benzene and other aromatic compounds are produced. Benzene, which has a normal boiling point of about 80° C. at ambient pressure, flashes out of the heated reaction mixture. Once all the precipitate slurry has been added to the reactor, the reaction mixture is further heated to its aqueous boiling point, which normally is in the range of about 100° to 102° C., depending upon the composition of the mixture, to complete the volatilization of any remaining organic compounds.

Vapors 36 from the reactor are condensed by a first condenser 38 and are separated into two phases in a first decanter 40. The aqueous phase 42 is recycled back into the hydrolysis reactor 34, and the organic phase 44 flows into an evaporator 46. Boiling continues in the hydrolysis reactor 34 in order to allow the hydrolysis reactions to approach completion and to steam-strip higher boiling aromatic compounds from the aqueous phase.

Once the hydrolysis reaction has proceeded for a sufficient amount of time, the organic phase 44 is decontaminated in the evaporator 46. By washing the organic phase, which comprises more than 90 percent by weight benzene, with water 48, cesium is extracted from the organic phase into the water. Any radioactive contamination of the organic phase is due to contact with droplets of the contaminated aqueous phase. No volatile cesium compounds are produced by the reactions. The evaporator 46 is then heated to boil away the benzene. This is followed by aqueous boiling to once again steam-strip the higher boiling aromatic compounds. The vapors 50 are condensed by a second condenser 52 and decanted into a second decanter 54. The organic phase 56 flows into a condensate tank 58, and the aqueous phase 60 is returned to the evaporator 46. The contaminated aqueous phase is conveyed back to the hydrolysis reactor through conduit 49.

The organic compounds in the condensate tank 58 are sampled to ensure they have been decontaminated to the level desired. The decontaminated organic material is pumped outside the waste process facility via conduit 62 and held for subsequent incineration. If the organic phase was found to contain any residual radioactivity, it would be recycled to the evaporator 46 via conduit 59 and the decontamination process repeated before the organic phase exited the facility.

Aqueous product 64 from the hydrolysis reactor nominally contains less than 10 percent of the original aromatic organic compounds and virtually all of the radioactivity. The aqueous product is then blended with high level radioactive sludge from the waste storage tank 10 elsewhere in the vitrification facility. Excess water is evaporated and glass-forming frit 29 is added. The resulting blend of concentrated sludge is fed to a glass melter for vitrification into borosilicate glass. The decreased amount of aromatic organic compounds in the sludge resulting from this process reduces the load on the melter off-gas system.

A minor amount of elemental mercury is generated in each hydrolysis reaction cycle due to its presence as a contaminant in the original precipitate slurry. Mercury is collected primarily in the first decanter 40, and is periodically recycled, via conduit 67, back into the hydrolysis reactor where it collects in the hydrolysis reactor sump. This accumulated mercury is later transferred to the chemical processing cell 68 through conduit 69. There are also minor accumulations of mercury in the reactor bottoms tank sump and organic evaporator condensate tank sump. Mercury pumps (not shown) can be placed in these sumps whereby the mercury can be transferred via conduits 70 and 72 to the mercury header 74 which leads to the chemical processing cell 68. There, the mercury is purified for eventual removal.

In a preferred embodiment, the invention is carried out as a batch process in which at least 10 percent, and preferably about 25 percent, of the aqueous product from a previous batch is recycled to be processed again. This serves to dilute the incoming feed of the next batch so as to make mixing easier.

As described above, soluble copper (II) catalyzes the acid hydrolysis of tetraphenylborate in the hydrolysis reactor. The optimum concentration of copper (II) has been found to be about 400 ppm in the reaction mixture after the precipitate has been added. The amount of copper (II) required to be added to each batch must also take into account the concentration of copper (II) remaining in the reactor. Higher concentrations of copper (II) have been tested and have not increased the amount of organic phase produced. The use of copper (II) concentrations of less than 300 ppm results in the production of lesser amounts of the organic phase. Both copper (II) sulfate and copper (II) formate were found to be equally effective in decomposing the tetraphenylborate precipitate and are to be considered preferred embodiments of the present invention. The use of the copper (II) catalyst in the hydrolysis process has improved the aromatic organic compound removal from a previous level of about 75 percent to a level of at least about 90 percent.

The use of copper (II) as a catalyst also provides two important advantages over previous hydrolysis processes. First, there is an increase in the overall reaction rate and a decrease in the temperature of the hydrolysis reaction so that high pressure containment vessels are not required. Ambient pressure is sufficient to achieve the improved results of the invention and the reactor vessels may actually be maintained at a slightly negative pressure in relation to ambient pressure in order to minimize any leakage or contamination of the environment.

Secondly, the use of copper (II) as a catalyst has also decreased foaming within the hydrolysis reactor to the extent that a pressurized reaction vessel is not necessary. Foaming is eliminated due to the increased reaction rate achieved through the use of the copper (II) catalyst. With the copper (II) catalyst, the precipitate reacts fast enough to destroy the foam-causing tetraphenylborate. The hydrolysis reaction is not completed immediately, but any intermediate compounds do not support foaming. The advantage of the copper (II) catalyst is clearly demonstrated by the fact that if the copper (II) catalyst is not used, foaming results. Without the foam problem, a nonpressurized reactor vessel can be used which greatly simplifies the process design.

After the hydrolysis reaction has reached completion the higher boiling aromatic hydrocarbons compounds are steam-stripped. The decanter 40 allows gravity phase separation of the organic and aqueous phases, with the latter being recycled to the reactor. The organic phase is removed by gravity overflow to the evaporator 46 for subsequent decontamination. At the end of the steam-stripping cycle, the acidic aqueous phase in the hydrolysis reactor contains the radionuclides, sodium, potassium, and boron salts from the original precipitate slurry, and less than 10 percent of the aromatic hydrocarbons originally contained in the precipitate.

Although the hydrolysis reaction may be performed with many acids, formic acid is particularly preferred because it does not provide an anion to react with the phenyl ions produced during the hydrolysis reaction. This reduces the number of reaction products which facilitates downstream processing.

The reaction mixture in the hydrolysis reactor should be maintained at a pH of below 5.0. This is achieved, for example, by adding a stoichiometric excess of formic acid to neutralize any hydroxides, nitrites, or carbonates formed during the reaction, plus 1.25 times the stoichiometric amount needed to react with the tetraphenylborate. The stoichiometry is represented by the following equations in which formic acid reacts with hydroxide, nitrite, and carbonate ions, and with the tetraphenylborate ion:

$$OH^- + HCOOH \longrightarrow HCOO^- + H_2O$$

$$2NO_2 + 3HCOOH \longrightarrow 2HCOO^- + 2NO + CO_2 + 2H_2O$$

$$CO_3^{-2} + 2HCOOH \longrightarrow 2HCOO^- + CO_2 + H_2O$$

$$B(C_6H_5)_4^- + HCOOH \longrightarrow HCOO^- + B(C_6H_5)_3 + C_6H_6$$

$$B(C_6H_5)_3 + 2H_2O \xrightarrow[Cu^{+2}]{} C_6H_5B(OH)_2 + 2C_6H_6$$

$$C_6H_5B(OH)_2 + H_2O \longrightarrow B(OH)_3 + C_6H_6$$

If the reactor heel, comprising any recycled aqueous phase from previous runs, has a pH of below 5.0, the above-mentioned amounts of formic acid are sufficient. If, however, the pH of the reactor heel is above 5.0, additional formic acid will be required to achieve the desired pH when the precipitate slurry is added and the hydrolysis reaction begins. Excess acid (pH below 5.0) is not detrimental to the hydrolysis reaction, but an insufficient amount of acid to offset the reactor heel may result in incomplete hydrolysis and reduced efficiency of the overall process.

It is important to note that no volatile cesium compounds or other radioactive compounds are formed during the hydrolysis reactions. Any cesium contamination of the organic phase is through entrainment in droplets of the aqueous phase during boiling from the reactor. Clean water is added to the organic phase in the evaporator 46 to extract the entrained cesium. A second batch distillation is then done in the evaporator 46 to separate the organic phase from the contaminated water. Both the reactor and evaporator may be operated about half-full with a low boiling flux and may have an impingement plate at the entrance to the vapor line leaving the vessel. Cesium is not normally considered to be soluble in benzene. The organic phase contains formic acid, water, and other compounds that may enhance the solubility. Double evaporation and extraction reduce the cesium concentration to the parts-per-trillion level. The decontaminated benzene-rich organic phase may be treated as a low-level hazardous waste.

EXAMPLE 1

Formic acid solution comprising 69 gallons of 90 percent formic acid (694 pounds HC00H) and copper (II) catalyst comprising 83 gallons of copper (II) formate solution (11.55 pounds copper (II) cation) are added into the hydrolysis reactor, agitated to encourage mixing, and heated to 90° C. at ambient pressure. When the reactor temperature reaches 90° C., 28,890 pounds of precipitate slurry, corresponding to 3430 gallons, having the composition listed in Table 1 is pumped into the hydrolysis reactor at a controlled rate over a period of 1 hour.

TABLE 1

| PRECIPITATE SLURRY FEED COMPOSITION | WT. %* |
|---|---|
| $H_2O$ | 88.2 |
| $KB(C_6H_5)_4$ | 8.95 |
| $NaNO_3$ | 0.705 |
| $NH_4B(C_6H_5)_4$ | 0.419 |
| $NaTi_2O_5H$ | 0.416 |
| NaOH | 0.284 |
| $NaNO_2$ | 0.175 |
| $NaAl(OH)_4$ | 0.156 |
| $Na_2C_2O_4$ | 0.115 |
| $Hg(C_6H_5)_2$ | 0.105 |
| $CsB(C_6H_5)_4$ | 0.093 |
| $Na_2SO_4$ | 0.084 |
| $NaB(C_6H_5)_4$ | 0.078 |
| $Na_2CO_3$ | 0.073 |
| $Fe(OH)_3$ | 0.058 |
| $Al(OH)_3$ | 0.055 |
| SLUDGE | 0.050 |
| NaCl | 0.007 |
| NaF | 0.003 |

*Calculated results scaled up from laboratory results
SP. GRAV. = 1.01
AROMATIC CARBON = 78.0 g/l
BATCH SIZE = 3430 gal. (28,890 lb)

At the end of this time the reaction mixture is heated to boiling (100° to 102° C.) and the vapors are distilled through the first condenser into the first decanter. In the first decanter, the organic and aqueous phases are separated, and any mercury is collected in a sump at the bottom of the decanter. Periodically, this mercury phase is drained back into the reactor and is subsequently transferred to a separate unit for purification.

The aqueous phase is continuously recycled from the first decanter back to the hydrolysis reactor during the distillation. The organic stream from the decanter is sent to an evaporator for further decontamination. The contents of the evaporator are heated to boiling and distilled into a second condenser and second decanter. The aqueous phase in this second decanter is recycled to the evaporator and the organic phase is sent to a condensate tank and is subsequently transferred to an outside incinerator.

The predicted compositions of the organic phase and aqueous phase resulting from the hydrolysis reaction are listed in Table 2 and Table 3, respectively.

TABLE 2

| AQUEOUS PRODUCT STREAM | WT. %* |
|---|---|
| $H_2O$ | 91.8 |
| KCOOH | 2.18 |
| $H_3BO_3$ | 1.37 |
| NaCOOH | 0.888 |
| $NaNO_3$ | 0.734 |
| $C_6H_5B(OH)_2$ | 0.676 |
| $NaTi_2O_5H$ | 0.432 |

TABLE 2-continued

| AQUEOUS PRODUCT STREAM | WT. %* |
|---|---|
| $C_6H_5OH$ | 0.385 |
| HCOOH | 0.318 |
| $Al(OH)_3$ | 0.164 |
| $Na_2C_2O_4$ | 0.119 |
| $Cu(CHO_2)_2$ | 0.100 |
| CsCOOH | 0.096 |
| $Na_2SO_4$ | 0.087 |
| $NH_4COOH$ | 0.081 |
| $Fe(OH)_3$ | 0.060 |
| $(C_6H_5)_2$ | 0.055 |
| SLUDGE | 0.052 |
| $C_6H_6$ | 0.032 |
| $(C_6H_5)_2NH$ | 0.031 |
| NaCl | 0.007 |
| NaF | 0.003 |

*Calculated results scaled up from laboratory results
SP. GRAV. = 1.03
AROMATIC CARBON = 8.8 g/l
BATCH SIZE = 3235 gal. (27,800 lb, not including approximately 15 lb of Hg)

TABLE 3

| ORGANIC PRODUCT STREAM | WT. %* |
|---|---|
| BENZENE | 90.4 |
| BIPHENYL | 4.95 |
| DIPHENYLAMINE | 3.37 |
| PHENOL | 0.730 |
| PHENYLBORIC ACID | 0.363 |
| p-TERPHENYL | 0.074 |
| DIPHENYLMERCURY | 0.068 |
| CHLOROBENZENE | 0.015 |
| ANILINE | T** |
| BROMOBENZENE | T |
| METHOXYBENZENE | T |
| NITROBENZENE | T |
| 2-NITROPHENOL | T |
| 4-NITROPHENOL | T |
| 2-NITRO-N—PHENYLBENZENAMINE | T |
| NITROSOBENZENE | T |
| 1-OXIDE-DIPHENYLDIAZENE | T |
| 1,1'-OXYBISBENZENE | T |
| PHENOXYPHENOL | T |
| PROPOXYBENZENE | T |
| 1,1'-SULFINYLBISBENZENE | T |
| m-TERPHENYL | T |
| o-TERPHENYL | T |
| TOLUENE | T |
| o-XYLENE | T |
| m-XYLENE | T |
| p-XYLENE | T |
| TRIPHENYLAMINE | T |

*Calculated results scaled up from laboratory results
**T = TRACE
SP. GRAV. = 0.89
SIZE = 330 gal. (2450 lb.)

Approximately 3 weight percent of the total precipitate feed remains in the reactor vessel after the first run as an organic residue. It was found, however, that residue does not accumulate with subsequent runs, but remains at about this level. This fact was confirmed by measuring the accumulations after 10 consecutive runs according to this Example (on a laboratory scale) without cleaning the reactor between runs. The residue comprises primarily biphenyl and diphenylamine, with additional small quantities of other high-boiling compounds.

EXAMPLE 2

In a continuous process according to the invention, the incoming streams of precipitate slurry, formic acid, and copper (II) catalyst are regulated so as to balance the outgoing streams of aqueous product and organic product. The amount of copper (II) catalyst in the hydrolysis reactor is maintained at the optimum level of about 300 to 400 ppm, based on the total amount of reactants, in order to achieve the most efficient, and effective, rate of the hydrolysis reaction. The temperature of the hydrolysis reactor is maintained at the aqueous boiling point of the reacting mixture. Aside from the obvious differences between continuous and batch processes, such as continuous rather than periodic recycling of intermediate product streams, the process herein described is essentially similar in other respects to that described in Example 1.

The foregoing description of preferred embodiments of the invention has been presented for purposes of illustration and description only. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A process for removing organic compounds from a radioactive waste precipitate slurry, comprising hydrolyzing said slurry with an acid in the presence of a catalytically effective amount of a copper catalyst comprising copper (II) cations and separating the resulting hydrolyzed organic compounds.

2. A process as claimed in claim 1, wherein the concentration of said copper (II) cations is above about 300 parts per million.

3. A process as claimed in claim 2, wherein the concentration of said copper (II) cations is in the range from about 300 to 400 parts per million.

4. A process as claimed in claim 1, wherein said copper catalyst is selected from the group consisting of copper (II) sulfate and copper (II) formate.

5. A process as claimed in claim 1, wherein said slurry is heated to a temperature of between about 70° to 100° C. to effect hydrolysis.

6. A process as claimed in claim 5, wherein said slurry is heated to a temperature of about 90° C. to effect hydrolysis.

7. A process as claimed in claim 5, wherein following said hydrolysis reaction, said slurry is further heated to effect removal of at least 90 percent of said organic compounds.

8. A process as claimed in claim 1, wherein the pH of said slurry is adjusted to be below about 5.

9. A process as claimed in claim 1, wherein said hydrolysis reaction is effected at ambient pressure.

10. A process as claimed in claim 1, wherein said acid comprises formic acid.

11. A process as claimed in claim 10, wherein said formic acid is present in a stoichiometric excess amount relative to the concentration of said organic compounds.

12. A process as claimed in claim 1, wherein said organic compounds comprise compounds containing the tetraphenylborate anion.

13. A process as claimed in claim 12, wherein said organic compounds comprise cesium tetraphenylborate.

14. A process for removing organic compounds from a radioactive waste precipitate slurry, comprising the steps of:

(a) contacting said precipitate slurry with an acid in the presence of a catalytically effective amount of a copper catalyst comprising copper (II) cations to form an acidified slurry;

(b) heating said acidified slurry to a sufficient temperature to effect hydrolysis of said organic compounds, thereby forming volatile organic compounds; and (c) separating said volatile organic compounds from said acidified slurry.

15. A process as claimed in claim 14, wherein the concentration of said copper (II) cations in the acidified slurry is above about 300 parts per million.

16. A process as claimed in claim 15, wherein the concentration of said copper (II) cations in the acidified slurry is in the range from about 300 to 400 parts per million.

17. A process as claimed in claim 14, wherein said copper catalyst is selected from the group comprising copper (II) sulfate and copper (II) formate.

18. A process as claimed in claim 14, wherein said slurry is heated to a temperature of between about 70° to 100° C. to effect hydrolysis.

19. A process as claimed in claim 18, wherein said slurry is heated to a temperature of about 90° C. to effect hydrolysis.

20. A process as claimed in claim 18, wherein following said hydrolysis reaction, said slurry is further heated to boiling to effect removal of at least 90 percent of said organic compounds.

21. A process as claimed in claim 14, wherein the pH of said slurry is adjusted to be below about 5.

22. A process as claimed in claim 14, wherein said hydrolysis reaction is effected at about ambient pressure.

23. A process as claimed in claim 14, wherein said acid comprises formic acid.

24. A process as claimed in claim 23, wherein said formic acid is present in a stoichiometric excess amount relative to the concentration of said organic compounds.

25. A process as claimed in claim 14, wherein said organic compounds comprise compounds containing the tetraphenylborate anion.

26. A process as claimed in claim 25, wherein said organic compounds comprise cesium tetraphenylborate.

* * * * *